United States Patent [19]

Asa et al.

[11] Patent Number: 4,674,640

[45] Date of Patent: Jun. 23, 1987

[54] CAP STRUCTURE FOR A CENTRIFUGE TUBE

[76] Inventors: Maurice Asa; David Asa, both of 1287 66th St., Emeryville, Calif. 94608

[21] Appl. No.: 843,070

[22] Filed: Mar. 24, 1986

[51] Int. Cl.[4] ..... B65D 41/18

[52] U.S. Cl. ..... 215/230; 215/306

[58] Field of Search ..... 215/228, 230, 306, 1 C

[56] References Cited

U.S. PATENT DOCUMENTS

| | | | |
|---|---|---|---|
| 1,920,396 | 8/1933 | Johson | 215/230 X |
| 2,911,128 | 11/1959 | Krautkramer | 215/306 X |
| 3,288,318 | 11/1966 | Corbin et al. | 215/1 C |
| 3,633,586 | 1/1972 | Sheridan | 215/306 X |

*Primary Examiner*—Donald F. Norton

*Attorney, Agent, or Firm*—Bruce & McCoy

[57] ABSTRACT

An improved cap structure for a centrifuge tube including a flat roughened texture surface on the top thereof especially adapted to permit writing thereon with a variety of standard writing instruments.

1 Claim, 6 Drawing Figures

CAP STRUCTURE FOR A CENTRIFUGE TUBE

BACKGROUND OF THE INVENTION

1. Field of the Invention

The present invention relates to centrifuge tubes. More particularly the present invention is an improvement in the cap structure for a centrifuge tube which includes a flat roughened surface to permit writing on the top of the cap.

2. Description of the Prior Art

The prior art of the present invention is illustrated in the drawings accompanying this specification and show a centrifuge tube employing the old type of cap structure. It has traditionally included an external recess on the top of the cap which is included for several purposes one of which is ease of manufacturing by reducing material thickness which has to solidify in the mold for quicker curing. The recess formed in the top of the cap also permits a savings in material required to manufacture the centrifuge tube. Further, the particular design provides a weakened resistance to the bending of that portion of cap which is inserted into the centrifuge tube as a stopper thereby permitting easier insertion of the cap into the top of the tube.

The problem with the prior art is that it has been impossible to conveniently write on a centrifuge tube in a consistent manner to identify it. The sides of the tube, which is made out of polypropylene, are inherently slick because of the properties of the material, and are sharply curved because of the small diameter of the tube, and as a result are difficult to write on. It has therefore always been necessary to include a label which is either adhesively stuck to the centrifuge tube or attached to it with a translucent adhesive tape.

If the tag is placed on the side of the tube, it can not be read in many cases without removing the tube from its holding rack or container. If the tag is not secured onto the side of the tube properly, the irregularity of the tag can make it difficult to insert or remove the tube from its holding rack or container. Tags glued to the tops or caps of the centrifuge tube are often torn off when the tube is opened. None of these tags prove to be a satisfactory solution to marking the tubes.

SUMMARY OF THE INVENTION

The present invention is an improved cap structure for a centrifuge tube. Each centrifuge tube has a sample receptacle formed therein with an open end. The internal walls of the receptacle are in most cases cylindrical and extend away from the open end. The cap structure of the tube includes a projecting portion which fits inside the open end of the receptacle as a stopper. Surrounding the projecting stopper portion is a flange which extends radially outward around the connection of the projecting portion with the flange of the cap. The improvement in the invention comprises forming the top of the cap structure on the opposite side of the cap from the projecting portion with a flat configuration. The flat surface has a roughened texture which is especially adapted to permit writing thereon with a variety of standard writing instruments.

OBJECTS OF THE INVENTION

It is therefore an important object of the present invention to provide a cap structure for a centrifuge tube which permits writing thereon.

It is another object of the present invention to provide a roughened surface on the flat portion of the cap structure to permit writing thereon with any standard type writing instrument.

Other objects of the invention will become apparent when the preferred embodiment described herein is considered in conjunction with the accompanying drawings.

DESCRIPTION OF THE PREFERRED EMBODIMENT

Figure 1:
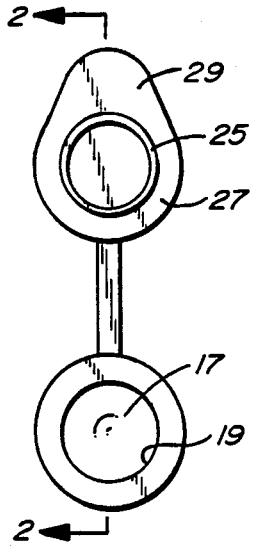
FIG. 1. (PRIOR ART)
FIG. 1 is a top plan view of a centrifuge tube of the prior art with the cap in the open position.
Figure 2:
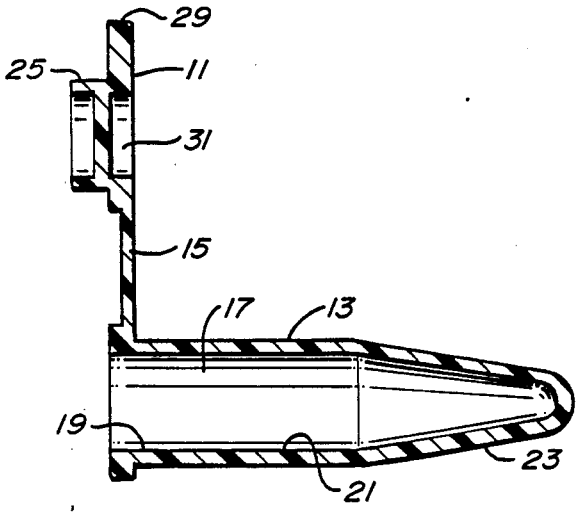
FIG. 2. (PRIOR ART)
FIG. 2 is a side elevation in cross-section taken along lines 2—2 of FIG. 1.
Figure 3:
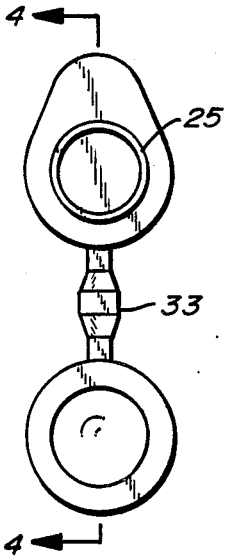
FIG. 3 is a top plan view of the centrifuge tube of the present invention employing the new cap structure.
Figure 4:
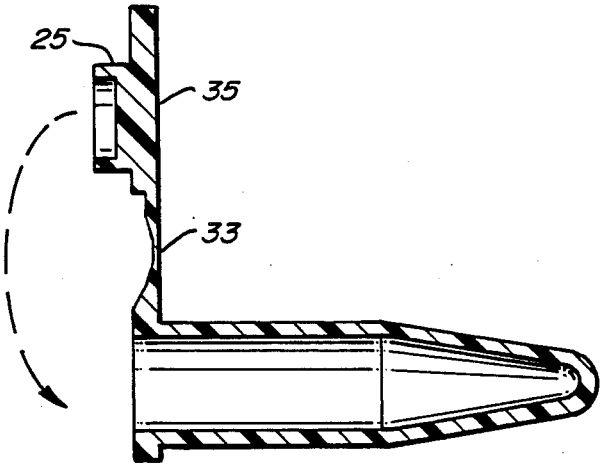
FIG. 4 is a side elevation in cross-section taken along lines 4—4 of FIG. 3.
Figure 5:
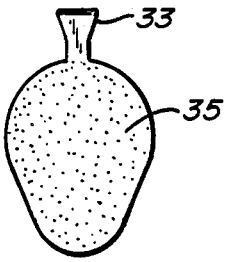
FIG. 5 is a top plan view of the cap structure of the present invention with the cap closed and inserted into the centrifuge tube.
Figure 6:
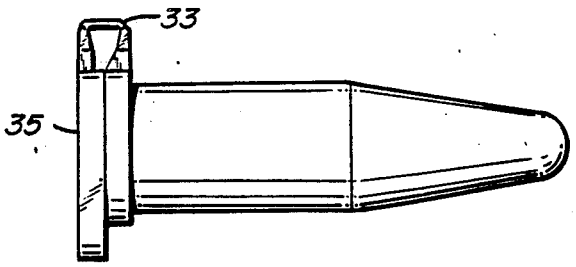
FIG. 6 is a side elevation of FIG. 5.

The present invention is an improved cap structure for a centrifuge tube having a sample receptacle formed therein. A centrifuge tube of the prior art is shown in FIGS. 1 and 2 of the drawings with the cap structure 11 attached to the centrifuge tube 13 by an integral flexible connection 15. The connector 15 permits the cap and tube to be made as a single unit in a molding process and maintains the cap with the tube at all times so that a matched cap for the tube is always available and cannot be lost. The flexible connection 15 is simply bent into a U-shaped configuration to allow the cap to be inserted into the centrifuge tube.

The sample receptacle 17 which is formed in the bottom of the centrifuge tube has an open end 19 and the internal walls 21 of the receptacle are cylindrical and extend away from the open end. The lower end of the receptacle is formed with a truncated conical section 23.

The cap structure of the centrifuge tube includes a projecting portion in the form of a hollow cylindrical flange 25 formed for fitting inside the open end 19 of the sample receptacle as a stopper. The flange making the hollow saves material cost as well as creating a compressible seal. A radially extending flange 27 is formed as a portion of the cap which extends radially outward around its connection to the cylindrical stopper projecting portion. The radially extending flange 27 has a greater radius of generation opposite the side of the cap structure which is secured to the flexible connection. The greater radius of generation forms an overlapping tab 29 which can be more easily grasped to pull the stopper from its seat in the sample receptacle.

The top of the cap structure, on the opposite side from the projecting stopper portion has traditionally been made with a recess 31. The recess reduces material cost and makes the cap structure more flexible for inserting and removing the stopper 25 from the sample receptacle 17.

In the present invention it has been found that by flattening the flexible connection 33 and squeezing the material into a narrower cross-section approximately in the center of the connecting tab, that the connection becomes more flexible and makes it easier to insert the stopper 25 into the sample receptacle. The flattening of the connection forms two fold lines in the material which permit sharp bends. The bend lines align the folding of the connection so that the cap aligns with the open end of the receptacle when it is being inserted.

The improvement of the invention is shown in FIGS. 3–6. It comprises forming the top of the cap structure 35 on the opposite side of the cap from the projecting stopper portion 25 with a flat rather than a recessed configuration and with a roughened texture surface (see FIG. 5) especially adapted to permit writing thereon with a variety of standard writing instruments. This improvement greatly enhances the versatility and utilization capability of the centrifuge tube by providing a laboratory tool that has an inherent identification capability that is consistently located in the same place, can be easily utilized, and can be read when the centrifuge tube is stored in a holding rack or container.

Thus, it will be seen that the invention will achieve all of the objects attributable thereto, and while the present invention has been described in considerable detail, it is not to be limited to such details as have been set forth herein except as may be necessitated by the appended claims.

We claim:

1. An improved cap structure for a centrifuge tube having a sample receptacle formed therein, said sample receptacle having an open end and the internal walls thereof being cylindrical and extending away from said open end, the cap structure of said tube being secured thereto with a flexible connection and including a projecting portion for fitting inside the open end of said receptacle and a flange extending radially outward around the connection of said projecting portion with the flange of said cap, the improvement comprising the top of said cap structure on the opposite side of the cap from said projecting portion having a flat configuration with a roughened texture surface especially adapted to permit writing thereon with a variety of standard writing instruments and said flexible connection having a flattened center section which causes the material to bend at predetermined positions along the connection to accurately position the cap for insertion in the open end of said receptacle.

* * * * *